United States Patent [19]

Eaton-Williams

[11] Patent Number: 4,853,693

[45] Date of Patent: Aug. 1, 1989

[54] AIR CONDITION MONITOR UNIT FOR MONITORING AT LEAST ONE VARIABLE OF THE AMBIENT AIR

[76] Inventor: Raymond H. Eaton-Williams, "Heathers", Farnaby Drive, Sevenoaks, Kent, England, TN13 2LQ

[21] Appl. No.: 47,118

[22] Filed: May 8, 1987

[30] Foreign Application Priority Data

May 9, 1986 [GB] United Kingdom ..... 8611360

[51] Int. Cl.[4] ..... G08B 17/00

[52] U.S. Cl. ..... 340/588; 340/589; 364/557; 236/94; 165/12

[58] Field of Search ..... 340/501, 514, 515, 584, 340/587, 588, 589, 517; 236/94, 91 F; 237/2 A; 165/11.1, 12, 13, 32; 219/482, 487, 494; 364/550, 557

[56] References Cited

U.S. PATENT DOCUMENTS

| | | | |
|---|---|---|---|
| 4,240,077 | 12/1980 | Hughes et al. | 340/501 |
| 4,274,145 | 6/1981 | Hendricks et al. | 364/557 |
| 4,308,911 | 1/1982 | Mandl | 340/501 |
| 4,338,511 | 7/1982 | Six | 340/589 |
| 4,411,385 | 10/1983 | Lamkewitz | 237/2 A |
| 4,606,401 | 8/1986 | Levine et al. | 165/12 |

*Primary Examiner*—Joseph A. Orsino
*Assistant Examiner*—Jill D. Jackson
*Attorney, Agent, or Firm*—Berman, Aisenberg & Platt

[57] ABSTRACT

An air condition monitor unit for monitoring the temperature and/or relative humidity of the ambient air. It comprises an air temperature sensor and a relative humidity sensor, and a plurality of memory means capable of retaining set values of respective thresholds comprising the maximum and minimum acceptable values of air temperature and relative humidity. Membrane switch means are connected to the plurality of memory means, operation of which switch means changes a set value retained in the plurality of memory means. Further membrane switch means are connected to the first switch means and the plurality of memory means, successive operation of which further switch means changes the memory means for the time being addressed by the first switch means from memory means to the next in a predetermined cycle. Warning means are connected to the sensors and the plurality of memory means to provide a warning signal in the event that one of the actual values of a given variable as indicated by the sensors passes a corresponding one of the retained values in the plurality of memory means.

13 Claims, 7 Drawing Sheets

AIR CONDITION MONITOR UNIT FOR MONITORING AT LEAST ONE VARIABLE OF THE AMBIENT AIR

The present invention relates to an air condition monitor unit, for example one which has an alarm that emits a visible or audible warning signal in the event that the temperature and/or relative humidity of the ambient air goes beyond a predetermined threshold value, possibly also in dependence upon whether the actual time is within pre-selected limits.

A problem that arises with such a unit is that different circumstances in which it may be used require different settings for the threshold values, and in some circumstances the threshold values need to be changed.

The present invention seeks to provide a unit which lends itself readily to simple and speedy setting or resetting of such threshold values.

Accordingly, the present invention is directed to an air condition monitor unit for monitoring the temperature and/or relative humidity of the ambient air, comprising (a) an air temperature and/or relative humidity sensor, (b) a plurality of memory means capable of retaining set values of respective thresholds comprising at least the maximum and minimum acceptable values of air temperature and/or relative humidity, (c) first switch means connected to the plurality of memory means, operation of which switch means changes a set value retained in the plurality of memory means, (d) second switch means connected to the first switch means and the plurality of memory means, successive operation of which second switch means changes the memory means for the time being addressed by the first switch means from one memory means to the next in a predetermined cycle, and (e) warning means connected to the sensor and the plurality of memory means to provide a warning signal in the event that one of the actual values of a given variable as indicated by the sensor passes a corresponding one of the reatined values in the plurality of memory means.

An example of a unit made in accordance with the present invention is illustrated in the accompanying drawings, in which:

FIG. 1 diagrammatically shows a front panel of the unit;

Figure 1:
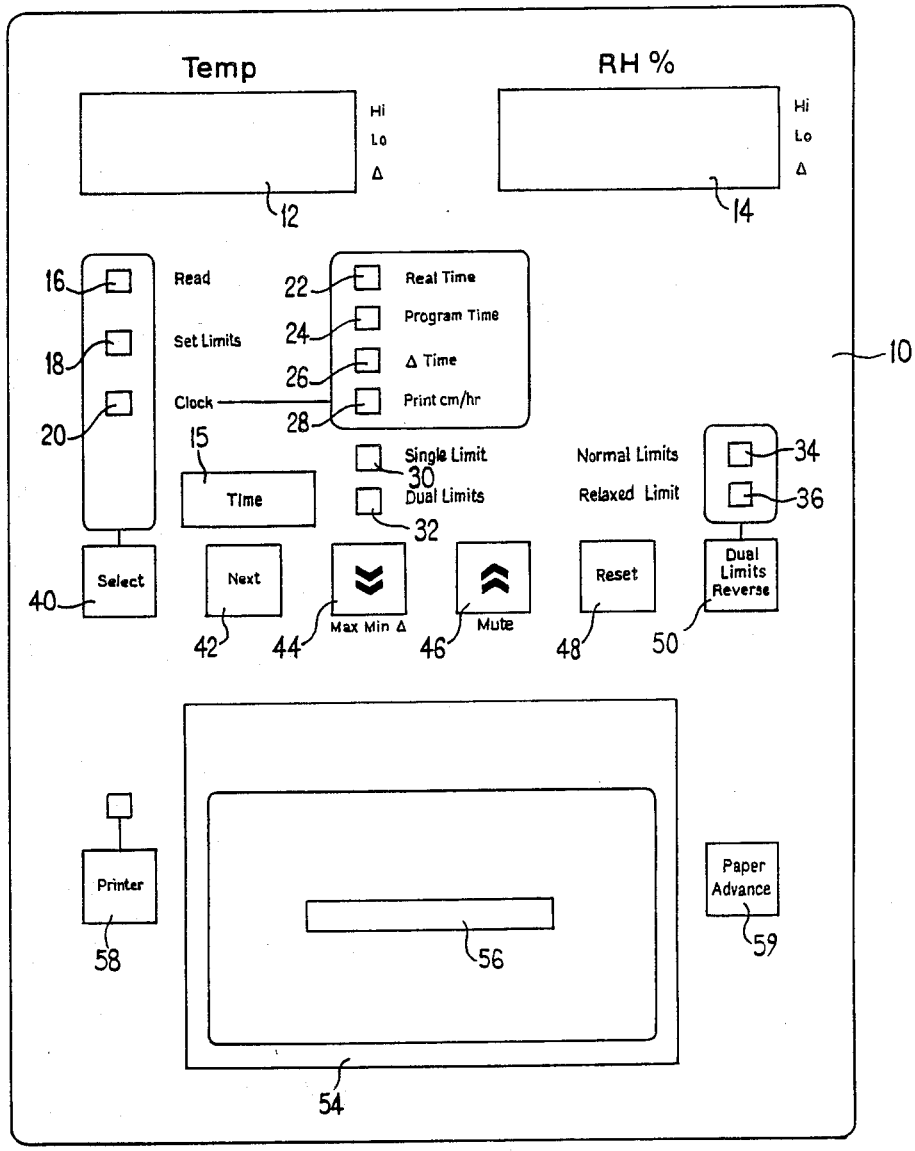

The unit of which the front panel 10 is shown in FIG. 1 comprises a wall-mounted housing 300 mm wide by 300 mm high by 120 mm deep. On the panel are three LED displays 12, 14 and 15 which relate to temperature, relative humidity, and time respectively, a plurality of LED indicators 16 to 36 relating to different functions to be described herein, six membrane switches 40 to 50, and a print unit 54 with a paper exit slot 56, an on/off override switch 58, and a paper feed switch 59.

Each LED display 12 or 14 comprises an array of LEDs for visually indicating in a setting mode of operation of the unit, three different preset numbers, being the maximum allowable value of the variable to which the display relates (temperature or relative humidity, for example), the minimum allowable value of that variable, and Δ, the maximum allowable rate of change of the value of that variable. In a normal read mode, these displays show the actual values of temperature, humidity and the rates of changes of these variables. It may also show maximum and minimums since last push of reset switch.

The LED indicators 16 to 36 are illuminted to show what the current operating function of the monitor is. Thus diode 16 shows when it is in a read mode, 18 when it is in a mode for setting or re-setting desired threshold or limit values, 20 when a clock of the monitor is being set, 22 when the real time for the clock is being set, 24 when the program start time is being set, 26 the time interval over which Δ is determined, 28 the papaer feed rate of a printer, 30 for when the monitor is set to operate with a single set of threshold or limit values, 32 for dual values, 34 to show when the normal thresholds or limits are being set, and 36 when relaxed threshold values or limits are being set.

When the select switch is operated, it shifts the mode from the normal read mode indicated by illumination of the LED indicator 16, to the set limits mode shown by indicator 18. Further operation of switch 40 causes the mode to transfer to the clock mode shown by indicator 20. Further operation of the select switch 40 returns the monitor unit to the read mode indicated by indicator 16. In the event that the unit is inadvertently left in the set limits mode or clock mode for longer than, say ten minutes, it automatically reverts to the read mode.

Depression of the switch 42 passes the unit on to whichever threshold or limit or value is to be set or reset next in a predetermined cycle, for the set limits mode and the clock mode. In the set limits mode, the present preset thresholds or limits for temperature and relative humidity are displayed on the LED displays 12 and 14. When, for example, the Δ value for temperature has been reached in the said predetermined cycle, this value may be decreased or increased by the down switch 44 and/or the up switch 46 until the desired new setting is illustrated at the position on the temperature display 12, whereupon the switch 48 is pressed to reset the value stored in the unit for the Δ temperature value as the value illustrated on the display. The full cycle for the set limits mode is as follows:

Normal Limits
Temperature maximum (HI)
Temperature minimum (LO)
Delta Temperature (Δ)
Relative humidity (RH) maximum (HI)
RH minimum (LO)
Delta RH (Δ)
Relaxed Limits
Temperature maximum (HI)
Temperature minimum (LO)
Delta Temperature (Δ)
Relative Humidity
(RH) maximum (HI)
RH minimum (LO)
Delta RH (Δ)

The relaxed limits may be less stringent than the normal limits, for example where the normal limits relate to normal working hours and the relaxed limits are for times outside normal working hours. This is a dual limit or threshold setting cycle, the timing division between normal and relaxed conditions being set in the clock mode. For single limit or threshold setting, the cycle is confined to the top half of the foregoing list, so that, when the unit is on, it operates only in accordance with the normal thresholds or limits. The mode of control passes from dual or single to the other by depression of the switch 50. Indicator 30 is illuminated to show when the unit is on single control, and indicator 32 when it is on dual control. Indicator 34 shows when the normal limits are being set or reset, and indicator 36 when the relaxed limits are being set or reset.

Clock values are set or reset in a similar manner. One of the indicators 22 to 28 is illuminated in conjunction with 20 to show which values, limits or thresholds are being set or reset. The values are shown on the display 15. Alternatively, the temperature display 12 or the relative humidity display 14 may also be used to display time values when it is desired to set or read those values. The display 15 can then be omitted. The clock cycle in the clock mode is as follows:

Day of
Actual time week
Day one
Start of normal control period
Start of relaxed control period
Day two
Start of normal control period
Start of relaxed control period
Day three
Start of normal control period
Start of relaxed control period
Day four
Start of normal control period
Start of relaxed control period
Day five
Start of normal control period
Start of relaxed control period
Day six
Start of normal control period
Start of relaxed control period
Day seven
Start of normal control period
Start of relaxed control period
Time interval over which rate of charge will be calculated (Δ time) is to operate.
Print speed (cm/hr).

Once the unit has been set in this way, and is left in the read mode, any deviation of the temperature or the relative humidity of the ambient air, as detected by respective sensors (not shown in FIG. 1), beyond the thresholds HI or LO to a value outside the HI to LO range, or any rise of the rate of change of one of these variables beyond the respective preset Δ threshold, will trigger a warning signal from an alarm (not shown in FIG. 1) of the unit, for example an audible tone of approximately 4 khz. At the same time, one of a plurality of LED indicators (not shown in FIG. 1) will be illuminated to show which threshold has been exceeded. Alternatively, this may be shown by constructing the unit to cause the relevant LEDs of the displays 12 and 14 to blink on and off. At the same time, a pair of isolated contacts of a relay in the unit may be closed, for example to switch on an air-conditioning unit that will correct the deviation or excessive rate of change.

Throughout the read mode, the print unit 54 produces a continuous graphical read-out of the control temperature and relative humidity values on a continuous strip of paper. The pring-out speed is that already preset as described previously herein, for example at any one of the speeds two, four or eight centimeters per hour. The paper strip is fed out through the slot 54, and may be stopped and re-started by the on/off switch 58. The range of the print-out may be 5 degrees centigrade to 35 degrees centigrade or 40 degrees Fahrenheit to 100 degrees Fahrenheit and 20 percent to 80 percent. Dotted parallel calibation lines may be produced by the printer itself for accuracy, at intervals of 5 degrees centigrade and 5 degrees RH.

Figure 2:
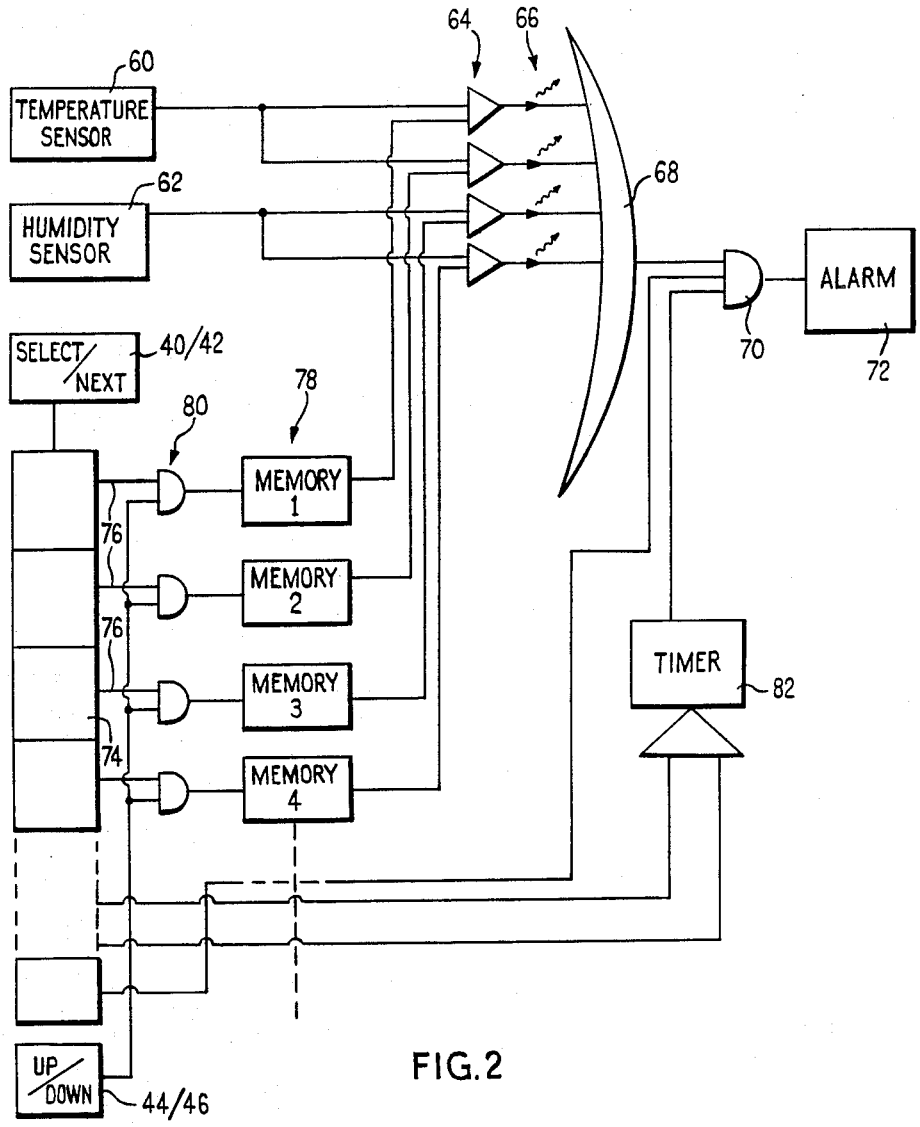
FIG. 2 is a circuit diagram of one possible electrical circuit for the unit.

The principle of construction of one possible electrical circuit for briging about operation of the unit as already described is shown diagrammatically in FIG. 2. Outputs from the temperature sensor 60 and the relative humidity sensor 62 are connected to respective inputs of a plurality of comparators 64, (not all of which are shown in FIG. 2). In FIG. 2, each sensor is shown connected to respective inputs of two comparators, for the sake of simplicity, relating respectively to the HI and LO values. Further outputs and comparators (not shown) would be provided for the Δ values, and a further set of comparators (not shown) for dual control. The outputs of the comparators 64 are connected, via respective LED indicators 66, to respective inputs of an OR gate 68, the output of which is connected to one input of an AND gate 70. The output of that AND gate 70 is connected to a triggering input of the alarm 72.

The circuitry further comprises a shift register 74 having a plurality of outputs 76 successively switched to a high level voltage in cyclical order upon successive operations of the select switch 40 and/or the next switch 42. In this way, successive associated memories 78 are addressed in the order corresponding to the setting cycles already described. The outputs of the shift register 74 are connected to the memories 78 via respective AND gates 80, which each have their second inputs connected to an output of the up/down switches 44/46. In the illustrated circuitry, for simplicity, an arrangement is shown which can only control alteration of the memory in one direction, say an increase, so that a decrease would be effected by increasing all the way to the upper limit of possible values, whereupon any further signal from the relevant AND gate would take the stored value in the memory back to its lowest value, and increase the stored value from there. A double up/-down control would be effected by a further set of AND gates and a further set of inputs to the memories. In the illustrated arrangement, memory 1 stores the temperature HI value, memory 2 the temperature LO value, memory 3 the RH HI value, and memory 4 the RH LO value.

A further set of memories (indicated generally by a broken line in FIG. 2) would be provided to set the timer limits.

Outputs of the relevant memories are connected to a clock or timer 82. This may have a number of outputs, one of which is shown connected to a further input of the AND gate 70, for monitoring within the normal thresholds or limits already referred to. Another output (not shown) connected to another AND gate (not shown) also connected to a further OR gate (not shown) would be provided for the relaxed thresholds or limits.

The lowermost output 76 of the shift register 74 happens to be related to the read mode in FIG. 2. This is connected to a third input of the AND gate 70.

In the illustrated circuitry, when, for example, the actual value of the temperature as sensed by the sensor 60 exceeds the present HI value stored in memory 1, as detected by the top comparator 64, the corresponding LED indicator 66 is illuminated, and an output is sent to one of the inputs to the AND gate 70 via the OR gate 68. Provided the unit is in the read mode, indicated by a signal from the lowermost output 76 of the shift register 74, and provided the illustrated output from the timer 82 shows that the normal thresholds are for the time being the controlling thresholds, a triggering signal is sent from the AND gate 70 to the triggering input of the alarm 72, which consequently emits a warning signal. At the same time, the illustrated LED indicator 66 shows which threshold has been passed.

Figure 3:
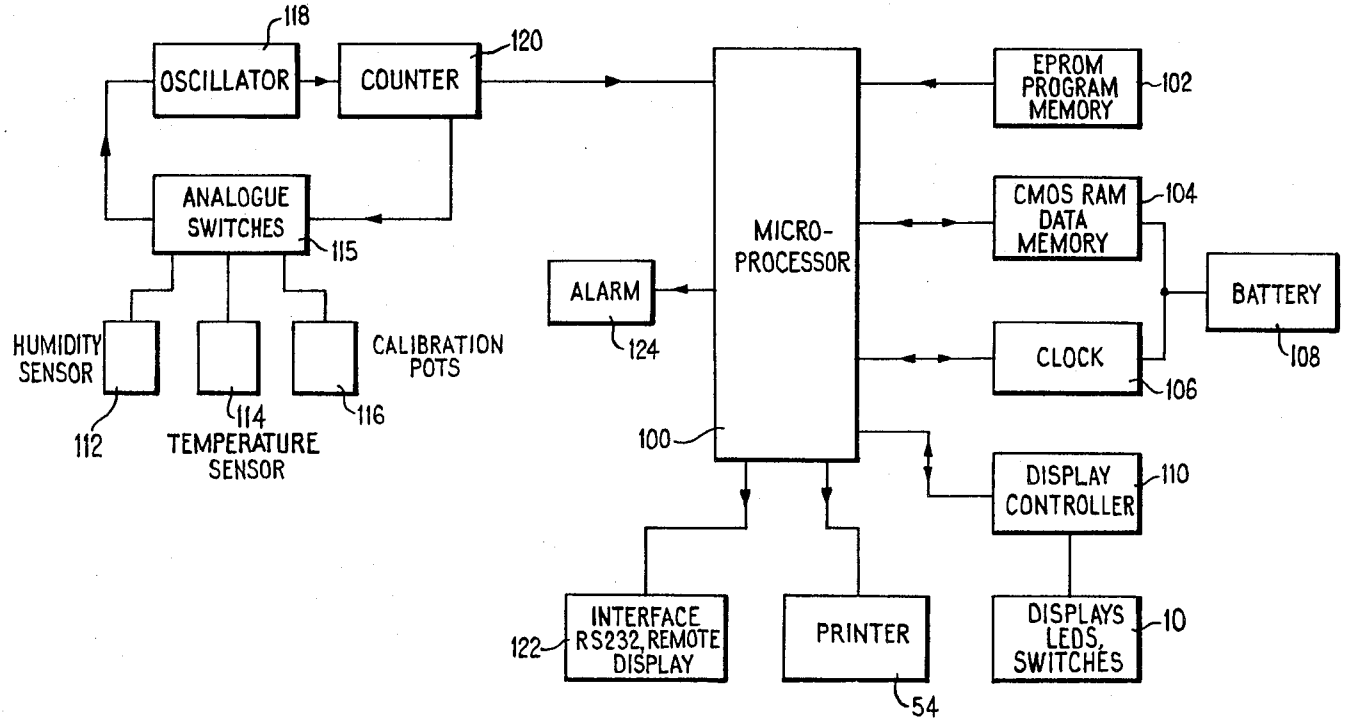
FIG. 3 is a block circuit diagram of a second possible electrical circuit for the unit.

The circuitry shown in FIG. 3 comprises a microprocessor 100 to which an operating programme is fed from an EPROM 102. A CMOS RAM 104 is also connected to the microprocessor 100 to exhange data therewith and store that data in its memory. A clock signal generator 106 is also connected to the microprocessor 100. The clock signal generator 106 and the CMOS RAM 104 are powered by a battery 108. The various displays, LEDs and switches of the front panel 10 of FIG. 1 are connected to the microprocessor 100 via a display controller 110. Actual humidity and temperature are fed into the microprocessor 100 by way of a humidity sensor 112 and a temperature sensor 114 which are connected to control analogue switches 115 in dependence upon the settings of calibration potentiometers 116. These in turn are coupled to an oscillator 118 connected in series with a multistage counter 120 which has an output connected to an input of the microprocessor 100. The latter has a further output which controls the printer 54, a further output to an RS 232 interface 122, for example for a remote display (not shown), and a further output connected to trigger an alarm 124.

Thus the circuit shown in FIG. 3 is one which is made to operate correctly by means of a program.

The counter 120 serves two purposes. Firstly it divides down the output of the oscillator 118 from say 100 kHz to a period of about 20 ms. Secondly, the output of the counter 120 is followed by a further three stages of binary division which provide select signals to the analogue switches 115. Thus each time the counter 120 provides an output signal to the microprocessor 100 the analogue switch selection is changed to the next in a sequence of eight. Each switch selection connects a different frequency control component to the oscillator 118. Thus, for instance, oscillation frequencies controlled by the humidity sensor, temperature sensor, reference capacitor, reference resistor, and calibration potentiometers are automatically cycled through. Each of the reference channels is of a significantly different frequency to the others which allows the microprocessor 100 to pick up synchronisation with the sensor unit.

The microprocessor 100 measures the duration of the various output periods from the sensor unit. Because the sensors 112 and 114 have a non linear characteristic the program has to allow for this when calculating the temperature and relative humidity. Once the program has values for temperature and humidity it then compares them against limits previously entered during the set mode. if an out of limits condition is found this is indicated by an audible alarm from the alarm 124 and a light emitting diode on the front panel 10.

The microprocessor 100 also calculates actual change values (Δ) for both temperature and humidity. The delta period (also settable from the front panel 10) is divided into 60 time slots. The average values, and the maximum and minimum average values of temperature and humidity for the last 60 time slots are stored in the CMOS RAM 104. The stored values are updated every sixtieth of the delta period, whereupon the oldest average values, are erased from memory and the most recent values are entered, and the maximum and minimum values updated if necessary. The current values are then compared against the stored maximum and minimum values for the previous 60 time slots and the largest differences found become the current actual delta values.

The microprocessor 100 and RAM 104 also store the maximum and minimum values of temperature and humidity since the reset button was last pushed. A mode of operation is provided that sequences through the display of maximum, minimum and delta values displaying each value in turn for about 3 seconds.

The program checks the switches regularly and responds accordingly if any switch is pushed. The displays and printer are also under programme control.

Figure 4:
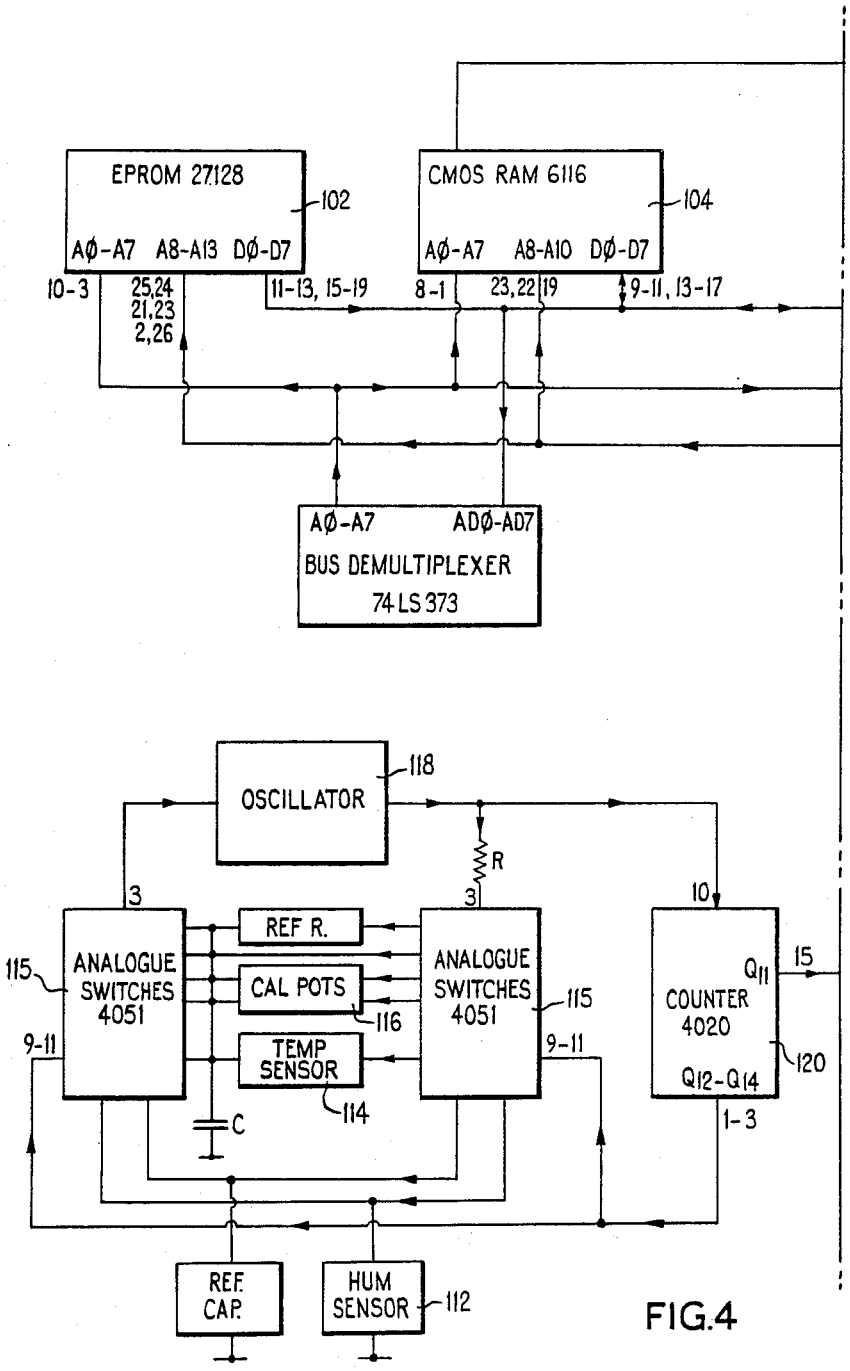
FIG. 4 is a more detailed block circuit diagram of the circuit shown in FIG. 3, indicating the actual electronic mocrochips used, and the pins of those chips which are used in the various interconnections.
Figure 4:
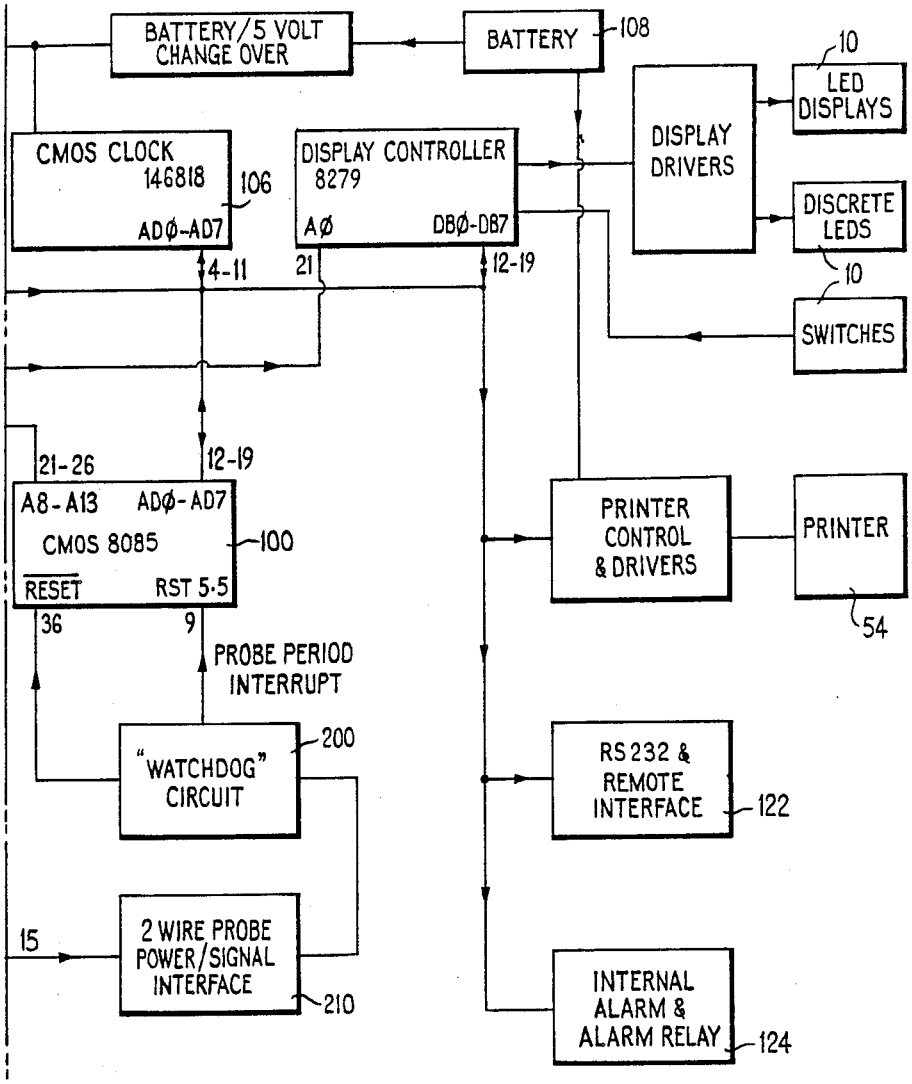

FIG. 4 shows the actual microchips used for the circuit shown in FIG. 3, and the manner in which the connecting pins of those chips are interconnected. It is believed that this is sufficient to enable a man of ordinary skill in the art to construct such a circuit. However, a few further points about the circuit should be mentioned specifically. The microprocessor part 100 of the circuit is a fairly standard implementation using an 8085 microprocessor, compatible peripheral integrated circuits, and integrated circuits from standard logic families. The "watchdog" circuit 200 shown in FIG. 4 provides an interrupt signal froma probe 210 and also adds security by resetting the unit should the microprocessor 100 fail to respond to the interrupt. For instance if the probe 210 is disconnected the unit will be shut down.

Considering the probe in greater detail, its design is based upon a standard circuit for an RC feedback oscillator where the values of R and C set the oscillation frequency. The analogue switches 115 are used to switch various values of R and C as well as the RH and temperature sensors into the feedback circuit, and thus the oscillation frequency depends on the feedback components selected at any given time. The oscillator output is connected to the multistage counter 120 with the final three outputs acting as select signals for the analogue switches 115. Also an output is taken to provide a time period signal which is related to the selected feedback components. The probe 210 is self contained, only requiring power to operate. One set of feedback components have been chosen so as to provide a significantly shorter output period than the other channels. The microprocessor program is then able to detect this and pick up sync with the probe 210.

Figure 5:
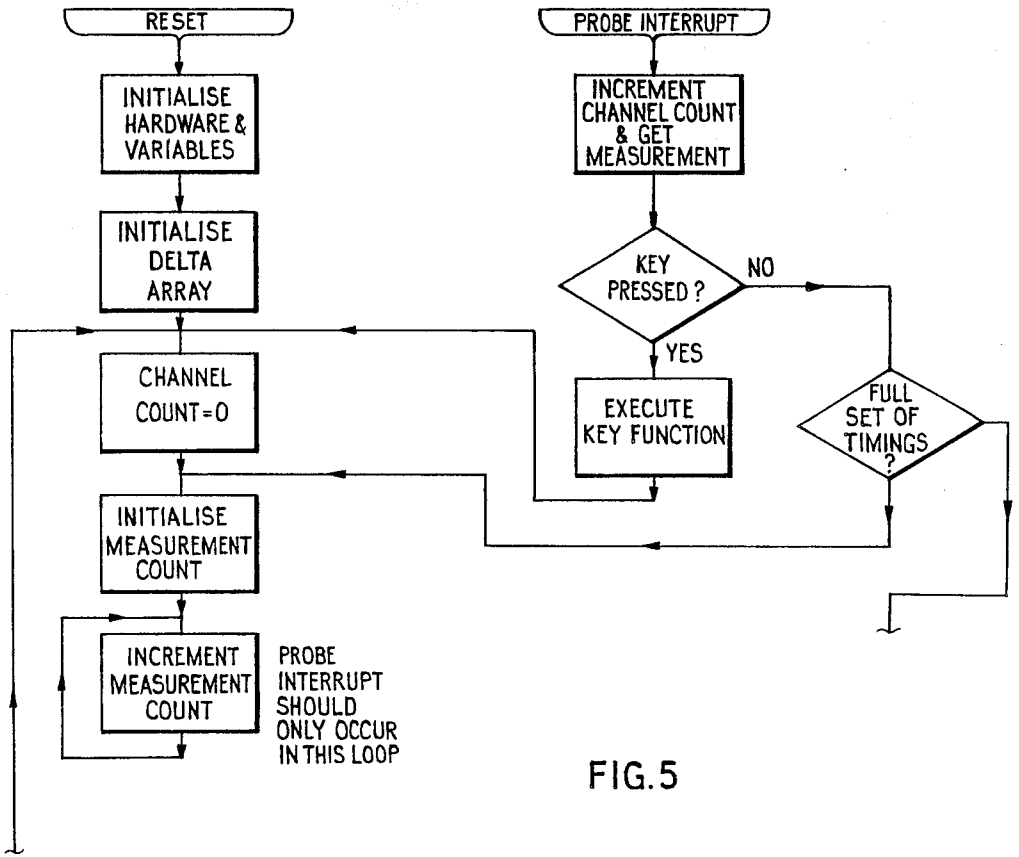
FIG. 5 shows the programme in accordance with which a programmable read only memory of the circuit shown in FIGS. 3 and 4 is programmed.
Figure 5:
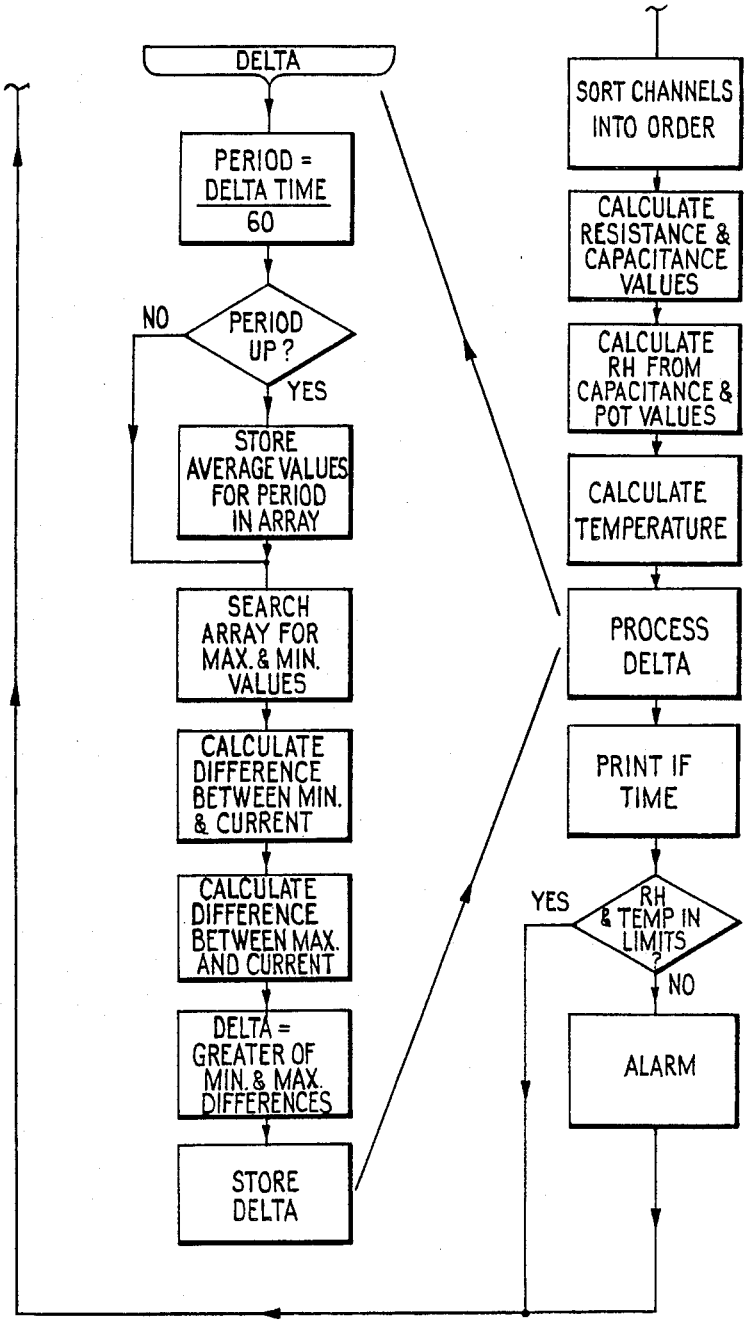

A flow chart showing the programme used to program the Eprom 102 is shown in FIG. 5. The program times the signal from the probe 210 shown in FIG. 4 and from the different durations calculates the values for temperature and relative humidity.

As already described, the user can set a time over which the delta measurement is processed. The programme then splits this into 60 time slots. Every time slot the average values of temperature and RH are stored. The current values of temperature and RH are then compared with the maximum and minimum values of the values stored in the 60 previous time slots and the delta value is the largest difference found.

Having completed the calculation of temperature, RH and delta values the program then checks these values against the alarm limits.

Numerous variations and modifications to the unit will readily occur to the reader without taking it outside the scope of the present invention. One has already been hinted at, that the two control switches 44 and 46 could be replaced by a single switch, which only increases the desired value or only decreases it until it reaches one extreme of the range of possible stored values, whereupon it continues from the other end of the range. The select and next switches 40 and 42 could be replaced by a single switch which carries the operator through a large cycle including setting thresholds and clock limits. The reset switch 48 could be omitted, its function being effected upon actuation of the "next" switch 42.

It will also be appreciated that the sensors and/or the alarm and alarm indicators could be at locations remote from the main unit, connected thereto by cable or radio.

I claim:

1. An air condition monitor unit for monitoring at least one variable of the ambient air, comprising (a) a sensor which provides an indication of the actual value of said at least one variable, (b) a plurality of memory means capable of retaining set values of respective thresholds comprising at least the maximum and minimum acceptable values of said at least one variable, (c) a first switch connected to said plurality of memory means, operation of which switch changes a set value retained in said plurality of memory means, (d) a second switch in cooperation with said first switch and connected to each of said plurality of memory means to selectively address at least either one of the memory means which retains said maximum acceptable value and the memory means which retains said minimum value, successive operation of which second switch changes the memory means which it selectively addresses, and thereby the memory means for the time being addressed by said first switch, from one memory means to the next in a predetermined cycle which includes at least the memory means which retains said maximum acceptable value and the memory means which retains said minimum value, so that operation of said first switch can be used to change the said maximum acceptable value and also the said minimum acceptable value, depending upon which memory means is for the time being addressed by both said first switch and said second switch, as selected by operation of said second switch, and (e) warning means connected to said sensor and said plurality of memory means to provide a warning signal in the event that one of the actual values of a given variable as indicated by said sensor passes a corresponding one of the retained values in said plurality of memory means.

2. An air condition monitor unit according to claim 1, in which said plurality of memory means includes one for retaining a set threshold value of the rate of change of a variable of the ambient air, address of that one of said plurality of memory means being included in said predetermined cycle, and in which rate of change measuring means are provided to give a measure of the actual value of said rate of change, the warning means also being connected to said rate of change measuring means to provide a warning signal in the event that the actual rate of change exceeds the set threshold value of said rate of change.

3. An air condition monitor unit according to claim 2, in which said rate of change measuring means comprises a timing device which provides a successionof signals each spaced in time by a predetermined period of time, a plurality of value memory means connected to said timing device and to said sensor to receive a signal indicative of the value of said at least one variable for each of a plurality of successive such predetermined periods of time and to store the value associated with that signal in respective ones of said plurality of value memory means, and difference means connected to said plurality of value memory means to provide an output signal which is indicative of the difference between the current value of said at least one variable and that one of the values stored in the said plurality of value memory means which differs most from said current value.

4. An air condition monitor unit according to claim 3, in which said predetermined period of time is adjustable.

5. An air condition monitor unit according to claim 1, in which display means are provided to give a display of the actual value of said at least one variable.

6. An air condition monitor unit according to claim 1, in which the display means are provided to give a display of said set threshold values.

7. An air condition monitor unit according to claim 6, in which the same display means display each of said set threshole values cyclically in order according to said predetermined cycle.

8. An air condition monitor unit according to claim 6, in which the same display means display both said actual value and said set threshold values, adn switch means are provided to change the display from actual to set values and vice versa.

9. An air condition monitor unit according to claim 1, in which switch means are provided to change the unit to and from a mode in which said set threshold values can be changed.

10. An air condition monitor unit according to claim 1, in which switch means are provided to change at least one period of time during any given day for which said set threshold values are effective.

11. An air condition monitor unit according to claim 10, in which the unit is subject to a different, relaxed set of threshold values during times outside such period.

12. An air condition monitor unit for monitoring at least one variable of the ambient air, comprising (a) a sensor which provides an indication of the actual value of said at least one variable, (b) a plurality of memory means capable of retaining set values of respective thresholds comprising at least the maximum and minimum acceptable values of said at least one variable, (c) a first switch connected to said plurality of memory means, operation of which switch changes a set value retained in said plurality of memory means, (d) a second switch in co-operation with said first switch and connected to said plurality of memory means, successive operation of which second switch changes the memory means for the time being addressed by said first switch from one memory means to the next in a predetermined cycle, and (e) warning means connected to said sensor and said plurality of memory means to provide a warning signal in the event that one of the actual values of a given variable as indicated by said sensor passes a corresponding one of the retained values in said plurality of memory means, wherein said plurality of memory means includes one for retaining a set threshold value of the rate of change of a variable of the ambient air, address of that one of said plurality of memory means being included in said predetermined cycle, and in which rate of change measuring means are provided to give a measure of the actual value of said rate of change, the warning means also being connected to said rate of change mesuring means to provide a warning signal in the event that the actual rate of change exceeds the set threshold value of said rate of change, adn wherein said rate of change measuring means comprises a timing device which provides a succession of signals each spaced in time by a predetermined period of time, a plurality of value memory means connected to said timing device and to said sensor to receive a signal indicative of the value of said at least one variable for each of a plurality of successive such predetermined periods of time and to store the value associated with that signal in respective ones of said plurality of value memory means, and difference means connected to said plurality of value memory means to provide an output signal which is indicative of the difference between the current value of said at least one variable and that one of the values stored in the said plurality of value memory means which differs most from said current value.

13. An air condition monitor unit according to claim 12, in which said predetermined period of time is adjustable.

* * * * *